US008419084B2

(12) United States Patent
Ding et al.

(10) Patent No.: US 8,419,084 B2
(45) Date of Patent: Apr. 16, 2013

(54) LOCK ASSEMBLY WITH MODIFIED STRUCTURE

(75) Inventors: Junliang Ding, Zengcheng (CN); Fubin Zhou, Zengcheng (CN)

(73) Assignee: Cmech (Guangzhou) Industrial Ltd. (CN)

( * ) Notice: Subject to any disclaimer, the term of this patent is extended or adjusted under 35 U.S.C. 154(b) by 362 days.

(21) Appl. No.: 12/778,232

(22) Filed: May 12, 2010

(65) Prior Publication Data

US 2011/0175373 A1 Jul. 21, 2011

(30) Foreign Application Priority Data

Jan. 20, 2010 (CN) ..... 2010 1 0110617

(51) Int. Cl.

| | |
|---|---|
| ***E05C 1/06*** | (2006.01) |
| *E05C 1/12* | (2006.01) |
| *E05B 3/00* | (2006.01) |
| *E05B 59/00* | (2006.01) |
| *E05B 63/14* | (2006.01) |

(52) U.S. Cl.
USPC ..... 292/144; 292/34; 292/336.3; 70/110

(58) Field of Classification Search ..... 292/144, 292/139, 347
See application file for complete search history.

(56) References Cited

U.S. PATENT DOCUMENTS

| | | | | |
|---|---|---|---|---|
| 8,158 | A * | 6/1851 | Yale et al. | 425/361 |
| 234,592 | A * | 11/1880 | Lemke | 292/144 |
| 3,783,658 | A * | 1/1974 | Wada | 70/110 |
| 4,656,850 | A * | 4/1987 | Tabata | 70/276 |
| 5,083,448 | A * | 1/1992 | Karkkainen et al. | 70/277 |
| 5,495,731 | A * | 3/1996 | Riznik | 70/108 |
| 6,651,466 | B1 * | 11/2003 | Shih | 70/107 |
| 7,770,423 | B2 * | 8/2010 | Wu | 70/218 |
| 2006/0266088 | A1 * | 11/2006 | Lee et al. | 70/107 |

FOREIGN PATENT DOCUMENTS

| | | |
|---|---|---|
| CN | 20082206160 | 12/2008 |

* cited by examiner

*Primary Examiner* — Thomas Beach
*Assistant Examiner* — Faria Ahmad
(74) *Attorney, Agent, or Firm* — Schmeiser, Olsen & Watts, LLP

(57) ABSTRACT

The present utility model discloses a smart lock with a modified structure comprising: a lock body including an inner handle and an outer handle, a latch and a bolt, an electrical locking mechanism for interfering retraction of the bolt; the lock body further comprises a manual locking and controlling mechanism connected to the inner and outer handles and controlling opening and closing; the manual locking and controlling mechanism is provided with a rotation actuating piece linked to the inner and outer handles and a bolt moving piece controlling extension and retraction of the bolt, wherein the rotation actuating piece is linked to the bolt moving piece via a locking member to control the bolt for locking when the inner and outer handles are lifted, and the rotation actuating piece is linked to the bolt moving piece via an unlocking member to control the bolt for unlocking when the inner and outer handles are pressed. The smart lock according to the present utility model has the following advantageous effects: 1. the smart lock exhibits a simple construction, less transmission components and easier manufacture and assembling, and is not liable to damage and easy to maintain; 2. the smart lock has a manual locking and unlocking function and is easy to operate and meanwhile has an electrical locking and unlocking function of ordinary smart locks, it is of low cost, safe and reliable and can be extensively applied to home and office anti-theft apparatuses.

9 Claims, 7 Drawing Sheets

LOCK ASSEMBLY WITH MODIFIED STRUCTURE

TECHNICAL FIELD

The present utility model relates to a lock assembly as an anti-theft apparatus, particularly a lock assembly with a manually locking and unlocking function.

BACKGROUND ART

Heretofore, locks for anti-theft doors mostly employ manual locking and unlocking and are complicated in structure, troublesome and inconvenient. Therefore, professionals in the art develop and produce a lock assembly which can be locked and unlocked automatically. Such lock generally comprises a bolt, an executing mechanism linked to the bolt, a motor bringing the execution mechanism into operation and a control circuit controlling the motor to work, wherein the control circuit controls the execution mechanism actuated by the motor, whereby the execution mechanism accomplishes locking or unlocking of the bolt. The operations of such lock are simple and quick. However, when the control circuit or execution mechanism of such lock assembly goes wrong, the lock cannot be duly repaired because professional repairers cannot reach the site timely or special component parts are lacked, whereupon the anti-theft doors cannot be locked or unlocked, thereby reducing security performance of the anti-theft door and causing great inconvenience to people's daily life. Although nowadays, some lock assemblys with a manual locking or unlocking function are available in the market, but such locks exhibit complicated structures, many components, inconvenient and troublesome manipulation and high costs.

SUMMARY OF THE UTILITY MODEL

An advantage of the present utility model is to overcome the shortcomings and drawbacks in the prior art and provide a lock assembly which is simple in structure, convenient in manipulation, safe and reliable and has a manual locking and unlocking function.

To achieve the above advantage, the present utility model is implemented with the following technical solutions:

A lock assembly with a modified structure comprises: a lock body including an inner handle and an outer handle respectively disposed on an inner and outer end sides of a door body, a latch and a bolt extensible into and retractable from an end side of a door frame, an electrical locking mechanism disposed in the lock body for interfering retraction of the bolt; the lock body further comprises a manual locking and controlling mechanism connected to the inner and outer handles and controlling opening and closing; the manual locking and controlling mechanism is provided with a rotation actuating piece linked to the inner and outer handles and a bolt moving piece controlling extension and retraction of the bolt, wherein the rotation actuating piece is linked to the bolt moving piece via a locking member to control the bolt for locking when the inner and outer handles are lifted, and the rotation actuating piece is linked to the bolt moving piece via an unlocking member to control the bolt for unlocking when the inner and outer handles are pressed.

Furthermore, the rotation actuating piece is respectively linked to the inner handle and the outer handle via a rotation shaft, and a lock actuating piece and an unlock actuating piece are respectively provided on two opposite sides of a peripheral end of the rotation actuating piece, wherein a first return spring applies a force on the lock actuating piece to make it return; the bolt moving piece is rotatably disposed in a mounting slot position in an interior chamber of the lock body and overly a profile mechanism. A positioning rotatable piece is provided at an axis of the bolt moving piece. At two opposite sides of the positioning rotatable piece are respectively provided a bolt moving lever bringing the bolt to extend and retract and a hook linked to the unlocking member. At a peripheral end of the positioning rotatable piece are respectively provided a fan-shaped gear linked to the locking member and a fan-shaped plate cooperating with an electrical locking mechanism to lock the bolt.

Furthermore, the locking member is a locking link and is slidingly coupled to and cooperates with a fixed point of an inner wall of the housing of the lock body, one end thereof engaging with and disengaging from the lock actuating piece of the rotation actuating piece, and an opposite end thereof being formed with a toothed strip meshing with and being transmissively coupled to the fan-shaped gear of the blot moving piece.

Furthermore, the unlocking member comprises: a latch moving piece movably provided on both sides of the rotation actuating piece and being coaxial with the rotation actuating piece, an inner interfering piece disposed on a lining of the latch moving piece, an upper interfering piece and a lower interfering piece being provided on both sides, the inner interfering piece engaging with and disengaging from the unlock actuating piece of the rotation actuating piece, wherein the upper interfering piece holds and is transmissively coupled to a latch link and is applied a force by a second return spring to return; an unlocking connecting piece rotatably coupled to an inner wall of the housing of the lock body via a torsional spring, wherein at both ends thereof are respectively provided an upper unlocking protrusion and a lower unlocking protrusion, wherein the upper unlocking protrusion 351 contacts and cooperates with the lower interfering piece of the latch moving piece, and the lower unlocking protrusion contacts and cooperates with the hook of the bolt moving piece.

Furthermore, an unlocking piece moveably embedded in a slot position of the positioning rotatable piece at an axis position of the bolt moving piece. At one end of the unlocking piece is circumferentially provided an unlocking lever. The slot position of the positioning rotatable piece extends outside to form an open-loop flange. The unlocking lever respectively engages and disengages with both ends of the opening of the open-loop flange.

Additionally, the unlocking lever is coupled to the fan-shaped plate of the bolt moving piece via a third return spring, a post is provided on an inner surface of the unlocking lever, and an arcuate guide groove slidingly mating with the post is provided on the surface of the fan-shaped plate.

Furthermore, at the periphery of the positioning rotatable piece of the bolt moving piece are provided a first straight edge and a second straight edge with a smooth arcuate transition therebetween; a positioning elastic tab is provided in the inner chamber of the lock body; the first straight edge and the second straight edge of the positioning rotatable piece respectively switch to abut against the positioning elastic tab when the bolt extends and retracts.

Furthermore, the above electrical locking mechanism comprises: a micromotor disposed in the inner chamber of the lock body; a reduction gearbox which input end is transmissively coupled to a main shaft of the micromotor and which output end is provided with an output rotation shaft with a fixed pin; a locking element comprising a first locking piece and a second locking piece that are mutually snap-fittable, wherein the first locking piece is moveably provided around the output rotation shaft and is hollowed out, the second locking piece is linked to the first locking piece and provided with a guide ramp; a locking spring movably provided around the output rotation shaft and helically snap-fitted with the fixed pin, with both ends respectively contacting and cooperating with two opposite inner walls of the first locking piece.

Furthermore, the above electrical locking mechanism further comprises a microswitch which contact engages with and disengages from an extension portion of the first locking piece to switch on or switch off.

Furthermore, the above electrical locking mechanism further comprises a smart control circuit, wherein the smart control circuit is respectively signal-connected to the micromotor and the microswitch.

As compared with the prior art, the present utility model has the following advantageous effects:

1. The lock assembly according to the present utility model exhibits a simple construction, less transmission components and easier manufacture and assembling, and is not liable to damage and easy to maintain;

2. The lock assembly has a manual locking and unlocking function and is easy to operate and meanwhile has an electrical locking and unlocking function of ordinary lock assemblys, it is of low cost, safe and reliable and can be extensively applied to home and office anti-theft apparatuses.

To understand the present utility model more clearly, specific implementation modes of the present utility model will be described with reference to the following accompanying drawings.

BRIEF DESCRIPTION OF THE ACCOMPANYING DRAWINGS

Figure 1:
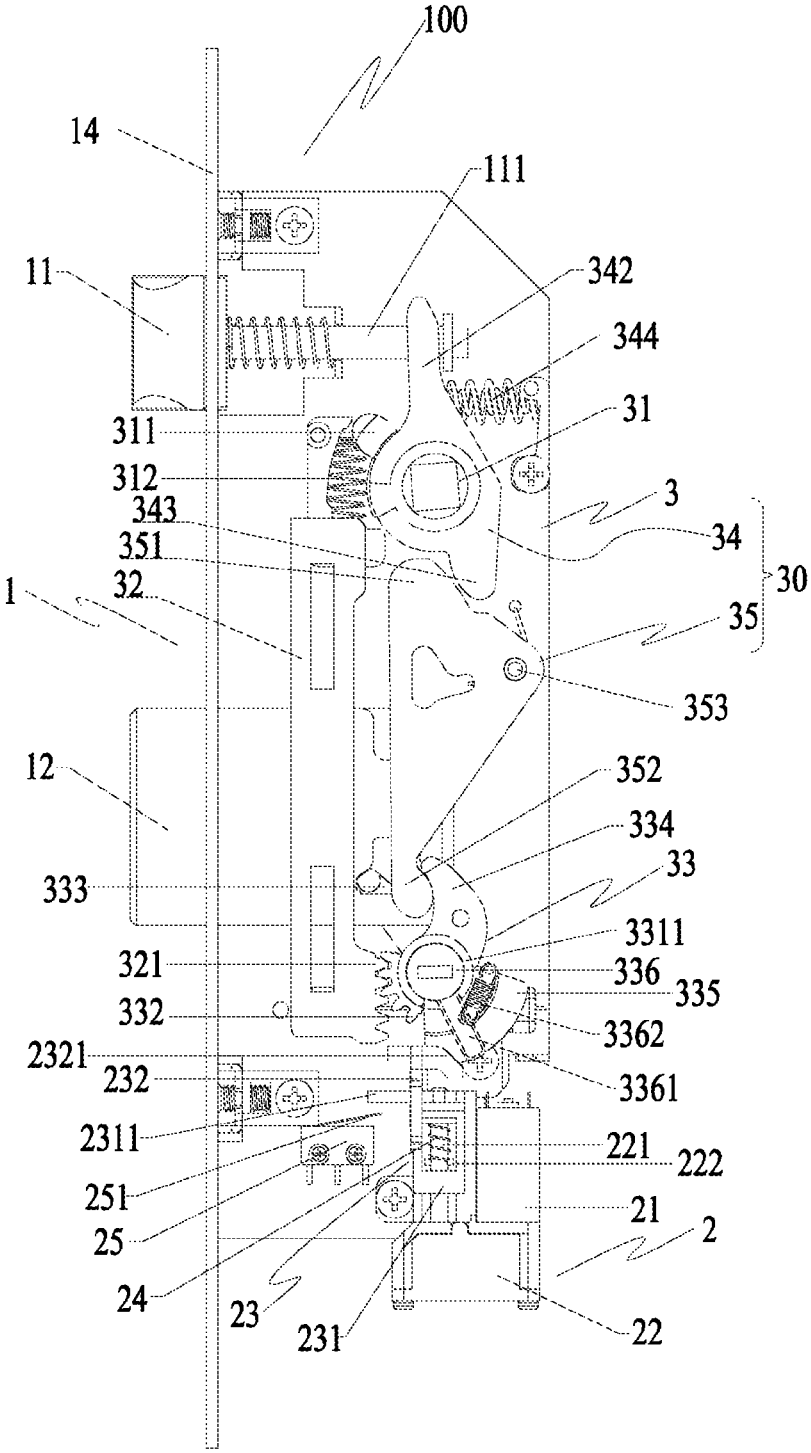
FIG. 1 is a structural schematic view of an interior of the present utility model.
Figure 2:
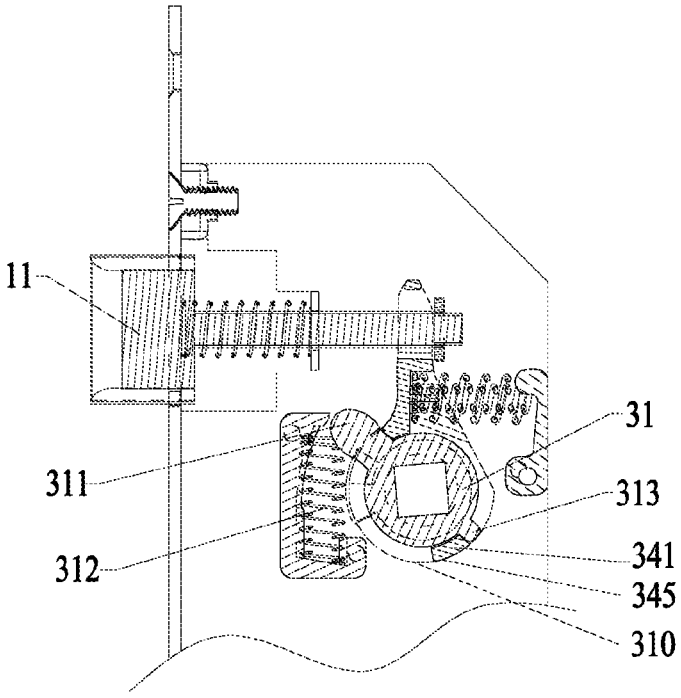
FIG. 2 is a structural schematic view of a rotation actuating piece and a latch moving piece in FIG. 1.
Figure 3:
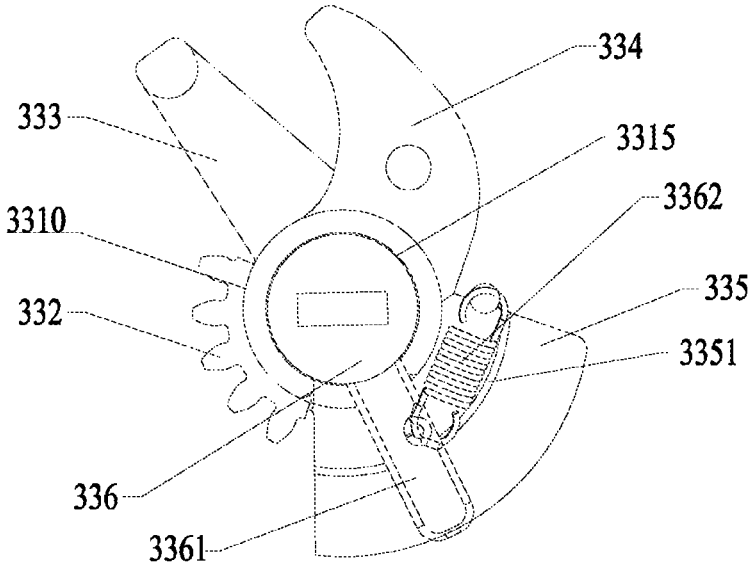
FIG. 3 is a structural schematic view of a bolt actuating piece in FIG. 1.
Figure 4A:
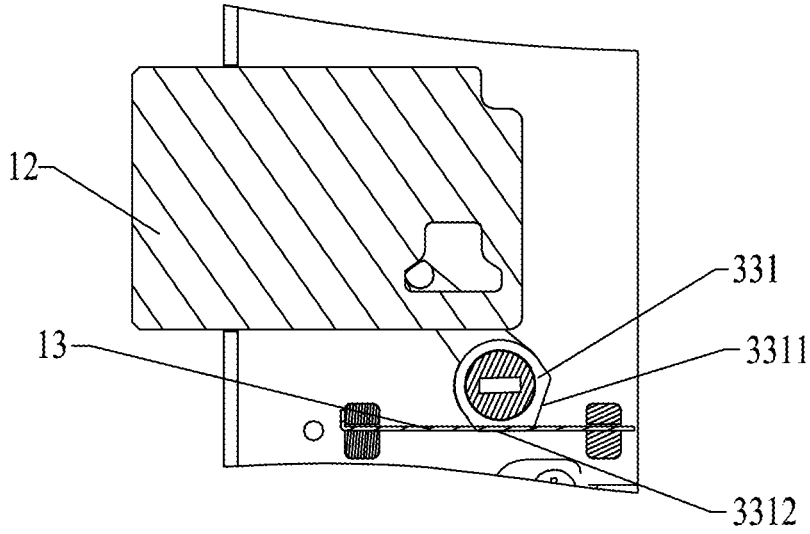
Figure 4B:
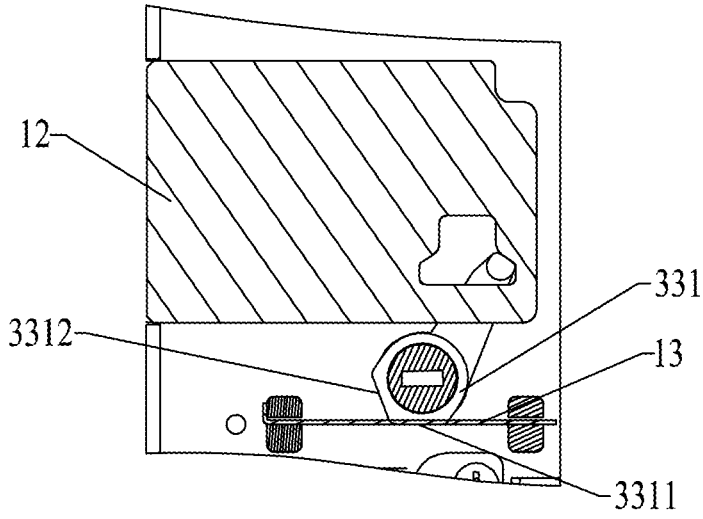
Figure 5:
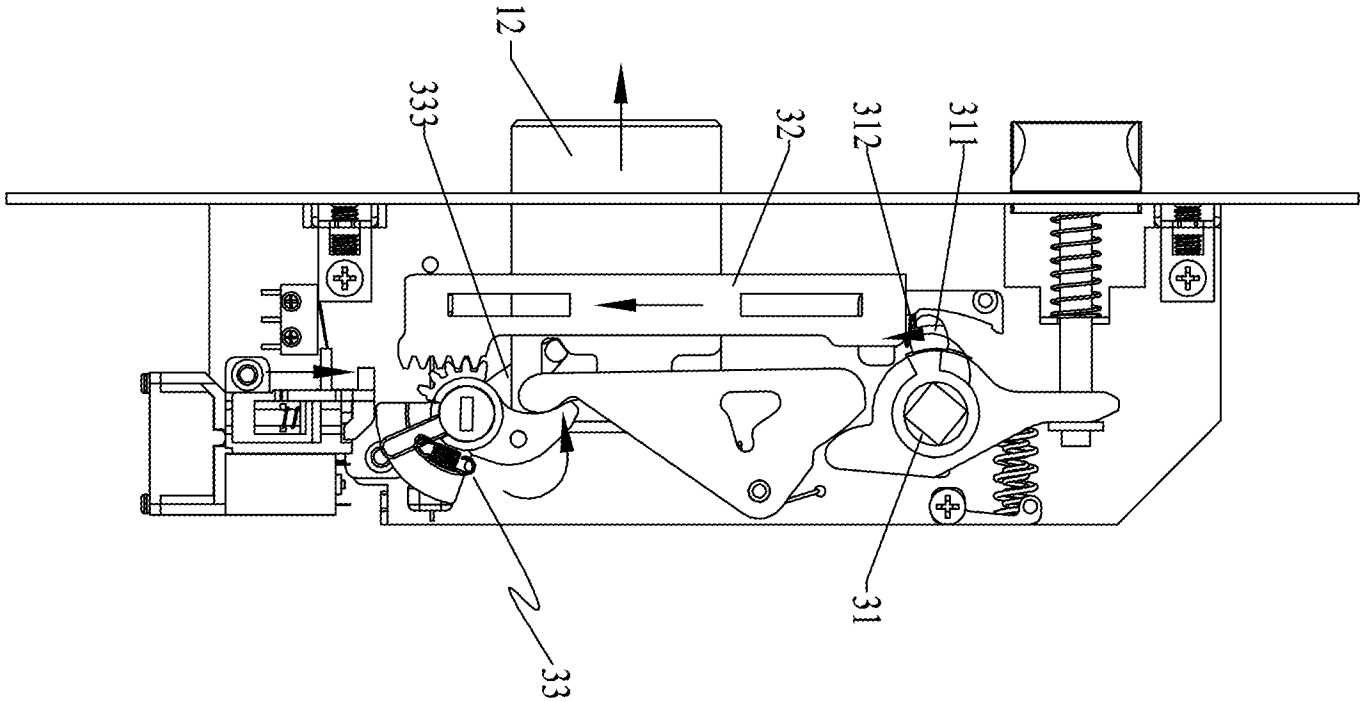
Figure 6:
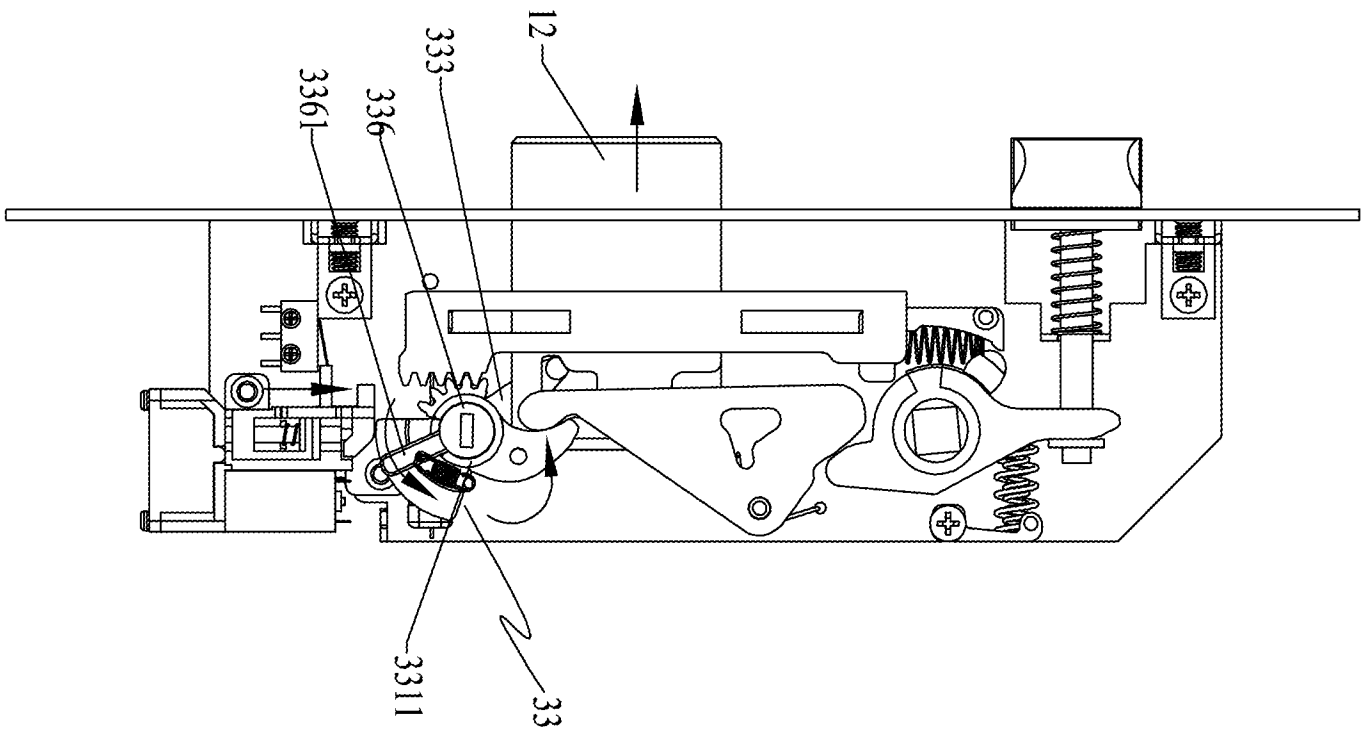
Figure 7:
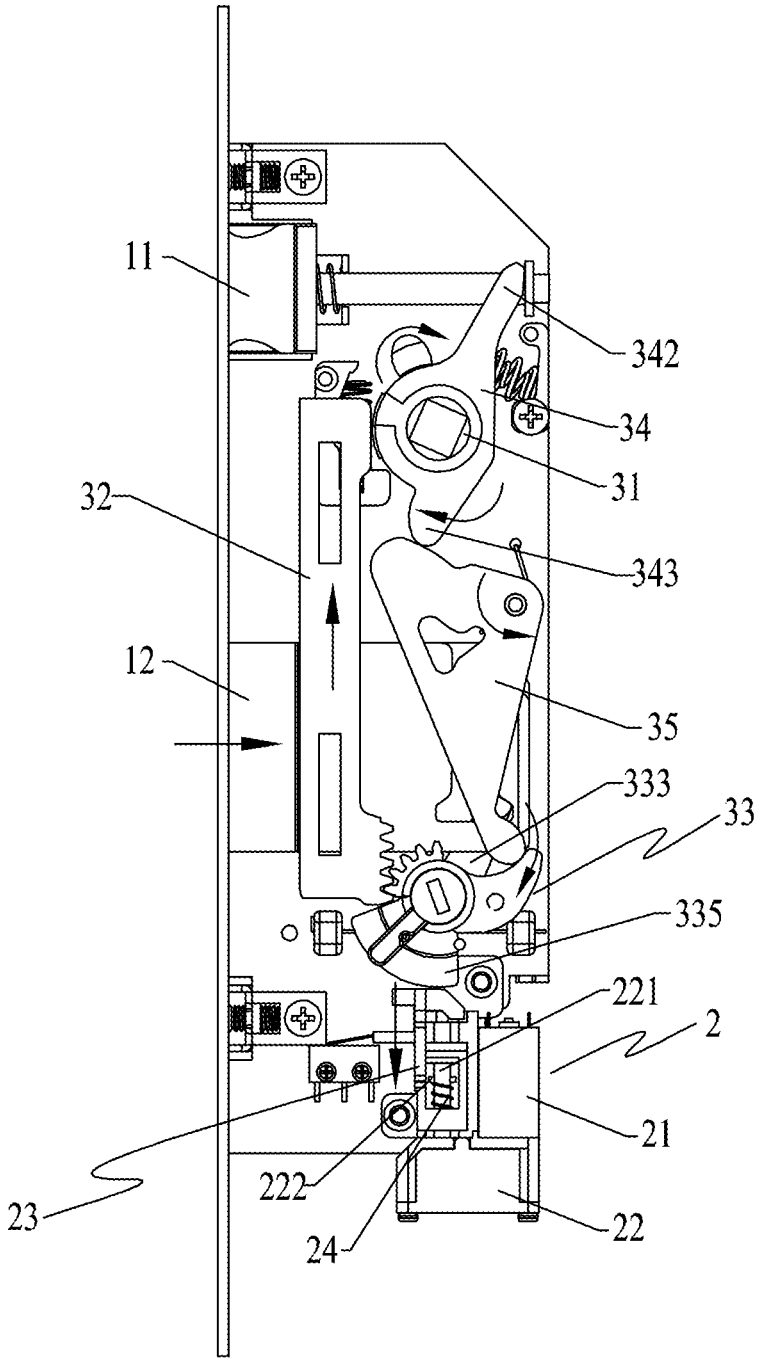

FIGS. 4*a*, 4*b* are structural schematic views of a positioning rotatable piece and a positioning elastic tab of FIG. 1;

FIG. 5 is a schematic view of a working state of locking via a handle;

FIG. 6 is a schematic view of a working state of locking via an unlocking piece;

FIG. 7 is a schematic view of a working state of smart unlocking; and

Figure 8:
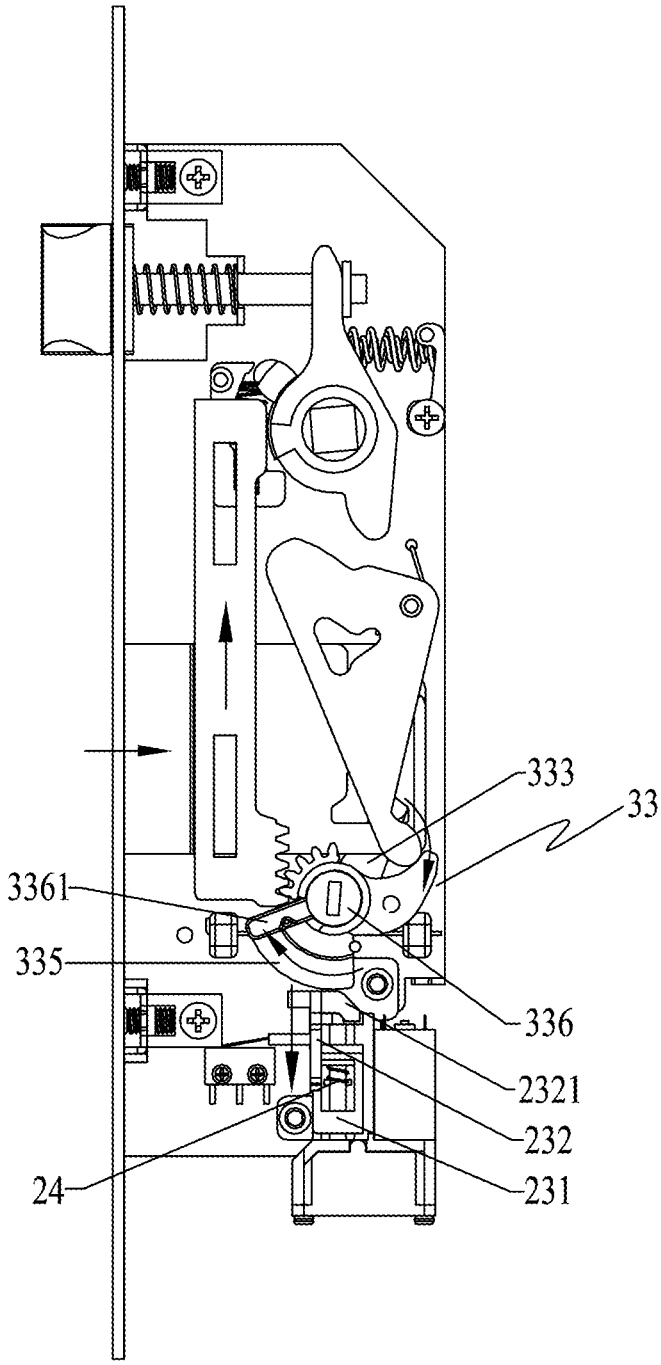

FIG. 8 is a schematic view of a working state of unlocking via an unlocking piece

DETAILED DESCRIPTION OF THE EMBODIMENTS

As shown in FIGS. 1-4, a lock assembly 100 with a modified structure according to the present utility model has a lock body 1 comprising an inner handle (not shown) and an outer handle (not shown) respectively disposed on an inner and outer end sides (not shown) of a door body (not shown), a latch 11 and a bolt 12 extensible into and retractable from an end side of a door frame (not shown), an electrical locking mechanism 2 disposed in the lock body for interfering retraction of the bolt, and a manual locking and controlling mechanism 3 connected to the inner and outer handles and controlling opening and closing.

The manual locking and controlling mechanism 3 is provided with a rotation actuating piece 31 linked to the inner and outer handles and a bolt moving piece 33 controlling extension and retraction of the bolt, wherein the rotation actuating piece 31 is linked to the bolt moving piece 33 via a locking member 32 to control the bolt 12 for locking when the inner and outer handles are lifted, and the rotation actuating piece 31 is linked to the bolt moving piece 33 via an unlocking member 30 to control the bolt 12 for unlocking when the inner and outer handles are pressed.

The rotation actuating piece 31 is respectively linked to the inner handle and the outer handle via a rotation shaft (not shown), and a lock actuating piece 311 and an unlock actuating piece 313 are respectively provided on two opposite sides of a peripheral end 310 of the rotation actuating piece 31, wherein a first return spring 312 applies a force on the lock actuating piece 311 to make it return; the bolt moving piece 33 is rotatably disposed in a mounting slot position (not shown) in an interior chamber (not shown) of the lock body 1 and overly a profile mechanism. A positioning rotatable piece 331 is provided at an axis of the bolt moving piece 33. At two opposite sides of the positioning rotatable piece 331 are respectively provided a bolt moving lever 333 bringing the bolt to extend and retract and a hook 334 linked to the unlocking member. At a peripheral end 3310 of the positioning rotatable piece 331 are respectively provided a fan-shaped gear 332 linked to the locking member 32 and a fan-shaped plate 335 cooperating with an electrical locking mechanism to lock the bolt. Preferably, an unlocking piece 336 moveably embedded in a slot position 3315 of the positioning rotatable piece 331 at an axis position of the bolt moving piece 33. At one end of the unlocking piece 336 is circumferentially provided an unlocking lever 3361 which is connected to the fan-shaped plate 335 of the bolt moving piece 33 via a third return spring 362. The slot position 3315 of the positioning rotatable piece 331 extends outwardly to form an open-loop flange 3313. The unlocking lever 3361 respectively engages and disengages with both ends of the opening of the open-loop flange 3313. In the meantime, a post (not shown) is provided on an inner surface (not shown) of the unlocking lever 3361, and an arcuate guide groove 3351 slidingly mating with the post is provided on the surface of the fan-shaped plate 335.

Furthermore, the locking member 32 is a locking link 32 and is slidingly coupled to and cooperates with a fixed point (not shown) of an inner wall (not shown) of the housing (not shown) of the lock body 1, one end thereof engaging and disengaging the lock actuating piece 311 of the rotation actuating piece 31, and an opposite end thereof being formed with a toothed strip 321 meshing with and being transmissively coupled to the fan-shaped gear 332 of the blot moving piece 33.

Furthermore, the unlocking member 30 comprises: a latch moving piece 34 movably provided on both sides of the rotation actuating piece 31 and being coaxial with the rotation actuating piece 31, an inner interfering piece 341 disposed on a lining 345 of the latch moving piece 34, an upper interfering piece 342 and a lower interfering piece 343 being provided on both sides, the inner interfering piece 341 engaging with and disengaging from the unlock actuating piece 313 of the rotation actuating piece 31, wherein the upper interfering piece 342 holds and is transmissively coupled to a latch link 111 and is applied a force by a second return spring 344 to return; an unlocking connecting piece 35 rotatably coupled to an inner wall of the housing of the lock body 1 via a torsional spring 353, wherein at both ends of the unlocking connecting piece 35 are respectively provided an upper unlocking protrusion 351 and a lower unlocking protrusion 352, wherein the upper unlocking protrusion 351 contacts and cooperates with the lower interfering piece 343 of the latch moving piece 34, and the lower unlocking protrusion 352 contacts and cooperates with the hook 334 of the bolt moving piece 33.

Preferably, at the periphery of the positioning rotatable piece 331 of the bolt moving piece 33 are provided a first straight edge 3311 and a second straight edge 3312 with a smooth arcuate transition therebetween; a positioning elastic tab 13 is provided in the inner chamber of the lock body 1; the first straight edge 3311 and the second straight edge 3312 of the positioning rotatable piece respectively switch to abut against the positioning elastic tab 13 when the bolt extends and retracts.

In another aspect, the above electrical locking mechanism 2 comprises: a micromotor 21 disposed in the inner chamber of the lock body 1; a reduction gearbox 22 which input end is transmissively coupled to a main shaft of the micromotor 21 and which output end is provided with an output rotation shaft 221 with a fixed pin 222; a locking element 23 comprising a first locking piece 231 and a second locking piece 232 that are mutually snap-fittable, wherein the first locking piece 231 is moveably provided around the output rotation shaft 221 and is hollowed out, the second locking piece 232 is linked to the first locking piece 231 and provided with a guide ramp 2321; a locking spring 24 movably provided around the output rotation shaft 221 and helically snap-fitted with the fixed pin 222, with both ends respectively contacting and cooperating with two opposite inner walls of the first locking piece 231; a microswitch 25 which contact 251 engages with and disengages from an extension portion 2311 of the first locking piece 231 to switch on or switch off, thereby controlling operation of the micromotor 21; and a smart control circuit (not shown) and power source, wherein the smart control circuit is respectively signal-connected to the micromotor 21 and the microswitch 25 to receive external electronic key signals and transmit signals to control operations of the micromotor and microswtich. The guide ramp 2321 of the second locking piece 232 abuts against the fan-shaped plate 336 of the bolt moving piece when the bolt is in a locked state so that the bolt moving piece 33 cannot rotate downwardly, that is, the bolt 12 cannot retract, thereby ensuring the locked state.

The working principles of the present utility model are as follows:

1. Locking a. locking via a handle: as shown in FIG. 5, the inner or outer handle is lifted, the handle brings the rotation actuating piece 31 to rotate counterclockwise via a rotation shaft, the lock actuating piece 311 of the rotation actuating piece 31 compresses the first return spring 312 to rotate downwardly counterclockwise to drive the locking link 32 to slide downwardly, the locking link 31 during downward sliding brings the bolt moving piece 33 to rotate upwardly counterclockwise, thereby driving the bolt moving lever 333 to bring the bolt 12 to extend outside; meanwhile a contact surface between the positioning rotatable piece 331 and the positioning elastic tab 13 switches from the first straight edge 3311 to the second straight edge 3312 (as shown in FIG. 4*a*) to allow the bolt 12 to quickly extend and then be positioned without return, thereby accomplishing the locking of the bolt 12.

b. locking via the unlocking piece: as shown in FIG. 6, an external force is applied to rotate the unlocking piece 336 upwardly counterclockwise; when the unlocking piece 336 rotates a certain angle, the unlocking lever 3361 of the unlocking piece 336 abuts against the open-loop flange 3313 of the positioning rotatable piece 331, thereby driving the bolt moving piece 33 to rotate upwardly counterclockwise and further driving the bolt moving lever 333 to bring the bolt 12 to extend outside, and meanwhile the contact surface between the positioning rotatable piece 331 and the positioning elastic tab 13 switches from the first straight edge 3311 to the second straight edge 3312 (as shown in FIG. 4*a*) to allow the bolt 12 to quickly extend and then be positioned without return, thereby accomplishing the locking of the bolt 12.

2. Unlocking a. smart unlocking mode: as shown in FIG. 7, after the smart control circuit of the electrical locking mechanism 2 identifies a correct electronic key, it sends signals to drive the micromotor 21 to rotate positively and drive, after gear-down by the reduction gearbox 22, the output rotation shaft 221 of the reduction gearbox 22 to rotate. Since the fixed pin 222 of the output rotation shaft 221 is helically snap-fitted with the locking spring 24, rotation of the output rotation shaft 221 bring the locking spring 24 to move downwardly, thereby urging the locking element 23 to move downwardly. After the locking element 23 moves downwardly a certain distance, the fan-shaped plate 335 of the bolt moving piece 33 loses a blocking action with respect to the second locking piece of the locking element 23, whereupon if the handle is pressed, the handle brings the rotation actuating piece 31 to rotate clockwise via the rotation shaft. Since the unlock actuating piece of the rotation actuating piece 31 abuts against the inner interfering piece of the latch moving piece 34, thereby bring the latch moving piece 34 to rotate downwardly clockwise, during rotation of the latch moving piece 34 the upper interfering piece 342 thereof brings the latch 11 to retract inwardly and the lower interfering piece 343 drives the unlock connecting piece 35 to rotate counterclockwise around a connection point, the unlock connecting piece 35 further brings the bolt moving piece 33 to rotate clockwise, thereby driving the bolt moving lever 333 to bring the bolt 12 to retract inwardly, and meanwhile driving the locking link 32 to slide upwardly, and meanwhile the contact surface between the positioning rotatable piece 331 and the positioning elastic tab 13 switches from the second straight edge 3312 to the first straight edge 3311 (as shown in FIG. 4*b*) to allow the bolt 12 to quickly retract and then be positioned without return, thereby accomplishing the unlocking.

b. unlocking via the unlocking piece: as shown in FIG. 8, an external force is applied to rotate the unlocking piece 336 downwardly clockwise; when the unlocking piece 336 rotates a certain angle, the unlocking lever 3361 of the unlocking piece 336 abuts against the guide ramp 2321 of the second locking piece 232 of the locking element and thereby urges the second locking piece 232 to move downwardly, the second locking piece 232 bringing the first locking piece 231 to compress the locking spring 24 to move downwardly. When the locking element moves downwardly a certain distance, the fan-shaped plate 335 of the bolt moving piece 33 loses a blocking action with respect to the second locking piece 232 of the locking element, whereupon the unlocking piece 336 is rotated clockwise, the unlocking lever 3361 of the unlocking piece 336 bringing the bolt moving piece 33 to rotate downwardly clockwise, thereby driving the bolt moving lever 333 to bring the bolt 12 to retract inwardly, synchronously driving the locking link 32 to slide upwardly. Meanwhile, the contact surface between the positioning rotatable piece 331 and the positioning elastic tab 13 switches from the second straight edge 3312 to the first straight edge 3311 (as shown in FIG. 4*b*) to allow the bolt 12 to quickly retract and then be positioned without return, thereby accomplishing the unlocking.

As shown in FIG. 1, the present utility model is not limited to the above preferred embodiments. If a lock plate 14 at one end side of the lock body 1 is loosened, and the latch 11 is rotated 180 degrees, the lock can be adapted for use when the door is opened on the left or on the right and used conveniently. Besides, the electrical locking mechanism 2 can be mounted to or removed from the lock body as a whole for ease of maintenance and replacement.

What is claimed is:

1. A Lock assembly with a modified structure comprises:

a lock body including an inner handle and an outer handle respectively disposed on an inner side and an outer end side of a door body;

a latch and a bolt extensible into and retractable from an end side of a door frame; and an electrical locking mechanism disposed in the lock body for interfering retraction of the bolt;

wherein the lock body further comprises a manual locking and controlling mechanism connected to the inner and outer handles and controlling locking and unlocking of the lock assembly;

wherein the manual locking and controlling mechanism is provided with a rotation actuating piece linked to the inner and outer handles and a bolt moving piece controlling an extension and a retraction of the bolt, wherein the rotation actuating piece is linked to the bolt moving piece via a locking member to control the bolt for locking when the inner and outer handles are lifted, further wherein the rotation actuating piece is linked to the bolt moving piece via an unlocking member to control the bolt for unlocking when the inner and outer handles are pressed;

wherein the rotation actuating piece is respectively linked to the inner handle and the outer handle via a rotation shaft, and a lock actuating piece and an unlock actuating piece are respectively provided on two opposite sides of a peripheral end of the rotation actuating piece, further wherein a first return spring applies a force on the lock actuating piece to make it return;

wherein the bolt moving piece is rotatable disposed on an inner wall of the lock body, a positioning rotatable piece is provided at an axis of the bolt moving piece, at two opposite sides of the positioning rotatable piece are respectively provided a bolt moving lever bringing the bolt to extend and retract and a hook linked to the unlocking member, and at a peripheral end of the positioning rotatable piece are respectively provided a fan-shaped gear linked to the locking member and a fan-shaped plate cooperating with an electrical locking mechanism to lock the bolt;

wherein, when the electrical locking mechanism identifies a correct electronic key, the electrical locking mechanism sends a signal to make the fan-shaped plate of the bolt moving piece lose a blocking action with respect to the electrical locking mechanism;

wherein if the handle is pressed, the handle brings the rotation actuating piece to rotate clockwise via the rotation shaft because the unlock actuating piece of the rotation actuating piece abuts against the unlocking member, thereby bringing the unlocking member to rotate downwardly;

wherein the rotation of the unlocking member brings the latch to retract inwardly and further brings the bolt moving piece to rotate clockwise, thereby driving the bolt moving lever to bring the bolt to retract inwardly, and meanwhile driving the locking member to slide upwardly, thereby accomplishing the unlocking.

2. The Lock assembly with the modified structure according to claim 1, wherein the locking member is a locking link and is slidingly coupled to and cooperates with a fixed point of an inner wall of the housing of the lock body, one end thereof engaging with and disengaging from the lock actuating piece of the rotation actuating piece, and an opposite end thereof being formed with a toothed strip meshing with and being transmissively coupled to the fan-shaped gear of the blot moving piece.

3. The Lock assembly with the modified structure according to claim 1, wherein the unlocking member comprises:

a latch moving piece movably provided on both sides of the rotation actuating piece and being coaxial with the rotation actuating piece, an inner interfering piece disposed on a lining of the latch moving piece, an upper interfering piece and a lower interfering piece being provided on both sides, the inner interfering piece engaging with and disengaging from the unlock actuating piece of the rotation actuating piece, wherein the upper interfering piece holds and is transmissively coupled to a latch link and is applied a force by a second return spring to return to the original position, when the upper interfering piece in the original position, the latch is in the extended position; and an unlocking connecting piece rotatably coupled to an inner wall of the housing of the lock body via a torsional spring, wherein at both ends of the unlocking connecting piece are respectively provided an upper unlocking protrusion and a lower unlocking protrusion, wherein the upper unlocking protrusion contacts and cooperates with the lower interfering piece of the latch moving piece, and the lower unlocking protrusion contacts and cooperates with the hook of the bolt moving piece.

4. The Lock assembly with the modified structure according to claim 1, wherein an unlocking piece is moveably embedded in a slot position of the positioning rotatable piece at an axis position of the bolt moving piece, at one end of the unlocking piece is circumferentially provided an unlocking lever, the slot position of the positioning rotatable piece extends outside to form an open-loop flange, and in that the unlocking lever respectively engages and disengages with both ends of the opening of the open-loop flange.

5. The Lock assembly with the modified structure according to claim 4, wherein the unlocking lever is coupled to the fan-shaped plate of the bolt moving piece via a third return spring, a post is provided on an inner surface of the unlocking lever, and an arcuate guide groove slidingly mating with the post is provided on the surface of the fan-shaped plate.

6. The Lock assembly with the modified structure according to claim 1, wherein at the periphery of the positioning rotatable piece of the bolt moving piece are provided a first straight edge and a second straight edge with a smooth arcuate transition therebetween, in that a positioning elastic tab is provided in the inner chamber of the lock body, and in that the first straight edge and the second straight edge of the positioning rotatable piece respectively switch to abut against the positioning elastic tab when the bolt extends and retracts.

7. The Lock assembly with the modified structure according to claim 1, wherein the electrical locking mechanism comprises:

a micromotor disposed in the inner chamber of the lock body;

a reduction gearbox which input end is transmissively coupled to a main shaft of the micromotor and which output end is provided with an output rotation shaft with a fixed pin;

a locking element comprising a first locking piece and a second locking piece that are mutually snap-fittable, wherein the first locking piece is moveably provided around the output rotation shaft and is hollowed out, the second locking piece is linked to the first locking piece and provided with a guide ramp; and a locking spring movably provided around the output rotation shaft and helically snap-fitted with the fixed pin, with both ends respectively contacting and cooperating with two opposite inner walls of the first locking piece.

8. The Lock assembly with the modified structure according to claim 7, wherein the electrical locking mechanism further comprises a microswitch which contact engages with and disengages from an extension portion of the first locking piece to switch on or switch off.

9. The Lock assembly with the modified structure according to claim 8, wherein the electrical locking mechanism further comprises a smart control circuit, wherein the smart control circuit is respectively signal-connected to the micromotor and the microswitch.

* * * * *